United States Patent [19]

Pickett

[11] 4,175,353

[45] Nov. 27, 1979

[54] TOY SIMULATED RAY GUN

[76] Inventor: Vaughn A. Pickett, 1684 Sacramento St., Berkeley, Calif. 94702

[21] Appl. No.: 866,753

[22] Filed: Jan. 3, 1978

[51] Int. Cl.[2] ..... A63H 33/26

[52] U.S. Cl. ..... 46/227

[58] Field of Search ..... 46/1 E, 226, 227

[56] References Cited

U.S. PATENT DOCUMENTS

| | | | |
|---|---|---|---|
| 3,064,390 | 11/1962 | Barnes | 46/232 |
| 3,531,890 | 10/1970 | Citron | 46/227 |

*Primary Examiner*—Louis G. Mancene
*Assistant Examiner*—Robert F. Cutting
*Attorney, Agent, or Firm*—Owen, Wickersham & Erickson

[57] ABSTRACT

A gun-like toy device for producing controllable audio and visual effects simulating a fictitious futuristic space-age weapon. The device has a general hand gun shape with a handle attached to a central body section that has an audio speaker on its upper side and a barrel-like front end portion with attached lamps. Packaged within the body and handle are electronic components comprising battery power means, timer means for causing the lamps to flash at a controllable rate, audio generation means connected to said speaker and said power means, control means for preselecting the level and frequency and thus the characteristic mode of the sound produced by said audio generation means and a mode switch means for selecting either a continuous high pitch warbling sound or a single "shot" or blast sound that rapidly decays when a trigger means on said handle is pulled to "fire" the gun and simultaneously activate said lamp means and said audio generation means in the preselected mode.

11 Claims, 10 Drawing Figures

14
24
26
12
30

24
26
24
18
20
30
12
10
14
16

32
20
4
4
30
50
52
56
12
58
28
34
38
40
46
48
42
14
28
20
126

20
118
116
60
114
112
110
108
58
40
38
106
100
98
96
94
104
102
56
92
42
84
54
82
86
76
78
74
80
24
88
38
34
30
146
30
38
46
52
72
48
71
70
122
64
120
62
32
144
30
142
66
28
68
36

TOY SIMULATED RAY GUN

This invention relates to toy guns or gun-like devices and more particularly to a futuristic "space-age" type toy gun capable of producing both audio and visual effects when triggered.

BACKGROUND OF THE INVENTION

The fascination of contemplating futuristic technological developments associated with such things as space exploration has long been prevalent with fiction writers and their followers of all ages. Many such writers have often described the use of fictitious "space-age" laser or "ray" guns used in interplanatory or "cosmic" combat and attempts have been made to simulate such weapons for those who wish to act out their futuristic fantasies. The problem has been to provide a gun-like toy device with sufficient realism and also one capable of producing a variety of visual and audio effects. In prior art toy gun devices, as shown in U.S. Letters Pat. Nos. 2,734,310, 2,783,588, for example, the broad concept of guns producing both light and sound are disclosed. Other U.S. Letters Pat., such as Nos. 2,208,313, 3,220,732, 3,294,401 and 3,531,890 show toy devices including guns and means for producing light and sound, and finally the U.S. Pat. No. 3,394,491 shows a toy having a transistorized noise generator in which the pitch can be varied. However, none of the aforesaid patents disclose a toy gun capable of producing a selectable variety of different sound and light effects that are characteristic of such space age weapons.

It is therefore one general object of the invention to provide a toy gun-like device that overcomes the limitations of prior devices and provides a multi-mode toy gun on which various modes of sound can be preselected and produced when the device is triggered.

Another object of the present invention is to provide a toy gun capable of producing a plurality of different preselected sounds in combination with light elements and yet one wherein all electronic components can be contained within the gun body and handle.

Another object of the invention is to provide a toy "space" gun capable of producing in one mode a high pitched continuously warbling vibrato sound in combination with flashing lights and in another mode a short sound blast which simulates a single shot or bolt of energy each time the trigger is activated.

Still another object of the invention is to provide a toy "space-age" gun that is easy to operate to provide a variety of different combinations of sound and light pulses to simulate its use and yet one which can be manufactured from standard electronic components packaged within the gun housing.

BRIEF SUMMARY OF THE INVENTION

To accomplish the aforesaid objectives, the present invention provides a toy gun comprising a handle with an attached body having the general configuration of a hand gun. Packaged within the handle and body are microcomponents of an electronic circuit having an audio section connected to a small speaker on the top of the body and a lighting section connected to small light bulbs at the muzzle end of the body. The lighting section of the circuit includes a first oscillator connected from a battery power source to an amplifier whose output activates the muzzle lights. The audio portion of the circuit in conjunction with the lighting section includes two additional oscillators connected in parallel to the same battery power source and to each other. The second oscillator controls vibrato speed and modulates the third or tonal oscillator at that speed. The output of the tonal oscillator is coupled to a high current audio amplifier which feeds the speaker and is designed to produce a high decibel warbling output from a relatively low voltage in one mode. In another mode for providing a single shot or "stun" blast effect, the third oscillator is controlled by a tonal decay component which switches a charged capacitance through an optoelectronic device that furnishes a decaying input to the third oscillator to create the single shot effect. A program switch allows an alternate optoelectric device to be used having a different decay characteristic to produce another single "shot" sound when the gun trigger is pulled.

A series of controls on the top of the toy gun allow its user to quickly change operating modes and also the volume and/or pitch of the sounds produced.

Other objects, advantages and features of the invention will become apparent from the following detailed description of one embodiment thereof presented in conjunction with the accompanying drawing.

DETAILED DESCRIPTION OF EMBODIMENT

Figures 1, 2, 3, 4:
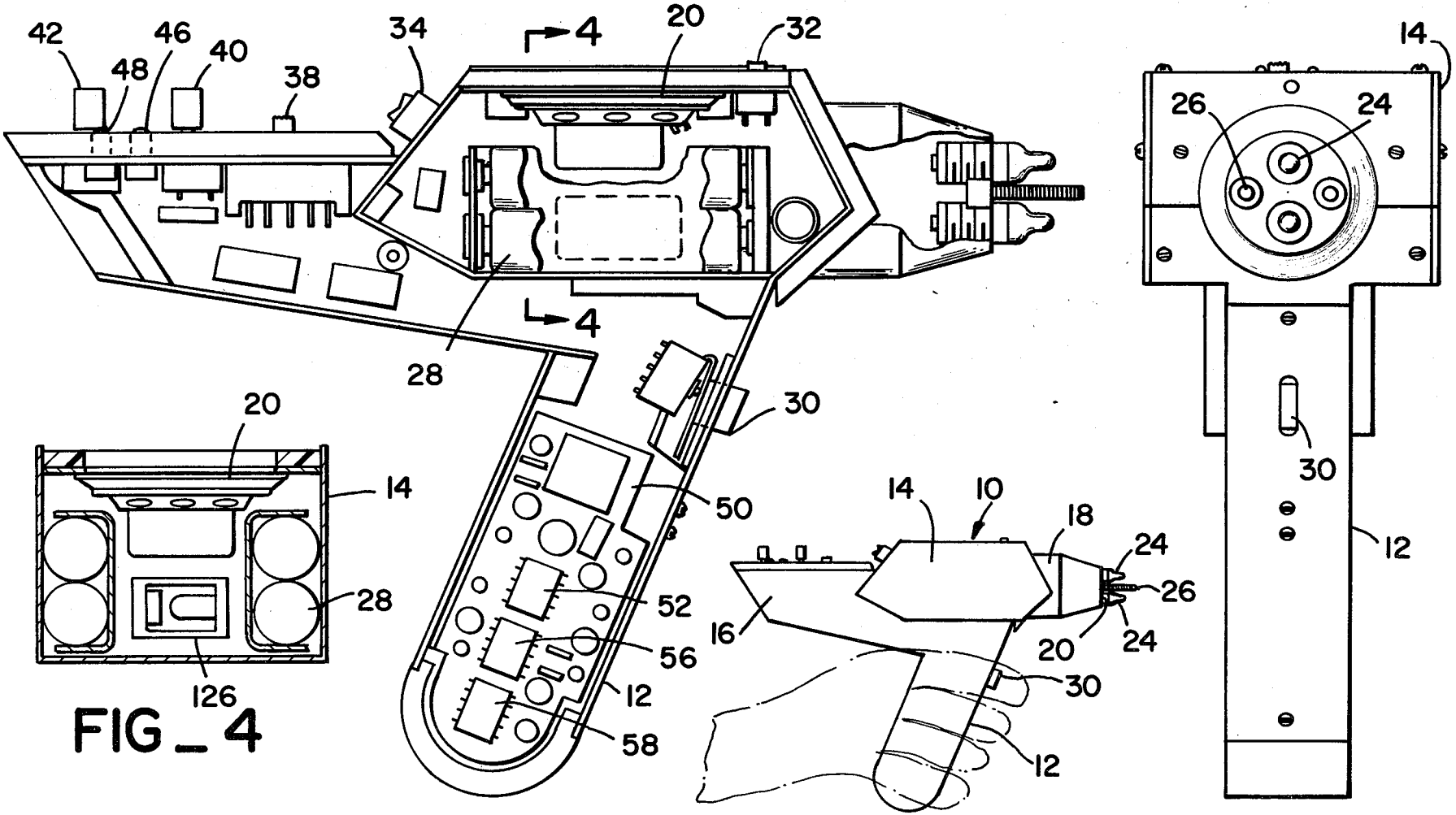
FIG. 1 is a view in elevation at a reduced scale showing a toy gun device according to the present invention.
FIG. 2 is a somewhat larger view of the toy gun device of FIG. 1 with the side panels of the device removed to show the arrangement of electronic components therein.
FIG. 3 is a view in front elevation of the toy gun shown in FIG. 2.
FIG. 4 is a view in section taken along line 4—4 of FIG. 2.

With reference to the drawing, FIG. 1 shows a toy gun 10 as it appears in one typical configuration according to the invention. In general, it comprises a hollow structure having a handle portion 12 adapted to be gripped by the user and attached to a central body portion 14 having a rear end portion 16 and a forward end or barrel portion 18. Both handle and body portions may be made from metal or rigid plastic parts that can be molded in the desired shape or prefabricated and assembled by conventional fasteners or bonding materials. In one preferred form the main portions of the body and handle fabricated from aluminum-sheet stock are combined with some elements and outer decorative strips of opaque plastic material. However, it is understood that different types of materials and combinations thereof can be utilized within the scope of the invention.

The handle portion 12 is generally rectangular and has a width and thickness which is appropriate to enable it to be held and gripped comfortably. Extending rearwardly from the upper end of the handle, the rear body section 16 has an upper generally planar surface on which are provided certain controls for operating the gun. Forwardly from the rear body section is the somewhat wider central body section 14 whose upper surface includes the outer cover of audio speaker cover 20. Extending forwardly from the central body section is the barrel portion 18 of the body that terminates at a muzzle-like end 20 on which are mounted a pair of flashing lamps 24. As shown, the lamps are positioned one above the other and between them I may also provide a pair of decorative projections 26 to simulate a make believe power or "ray" source.

The handle and body portions may be provided with removable side panels to facilitate easy access to the electrical components packaged therein. In FIG. 2, the gun 10 is shown with such side panels removed or broken away to indicate the location of various components. In the enlarged central body section 14, two pairs of penlight type dry cell batteries 28 are provided on opposite sides of the speaker 20 which faces upwardly.

Figure 5:
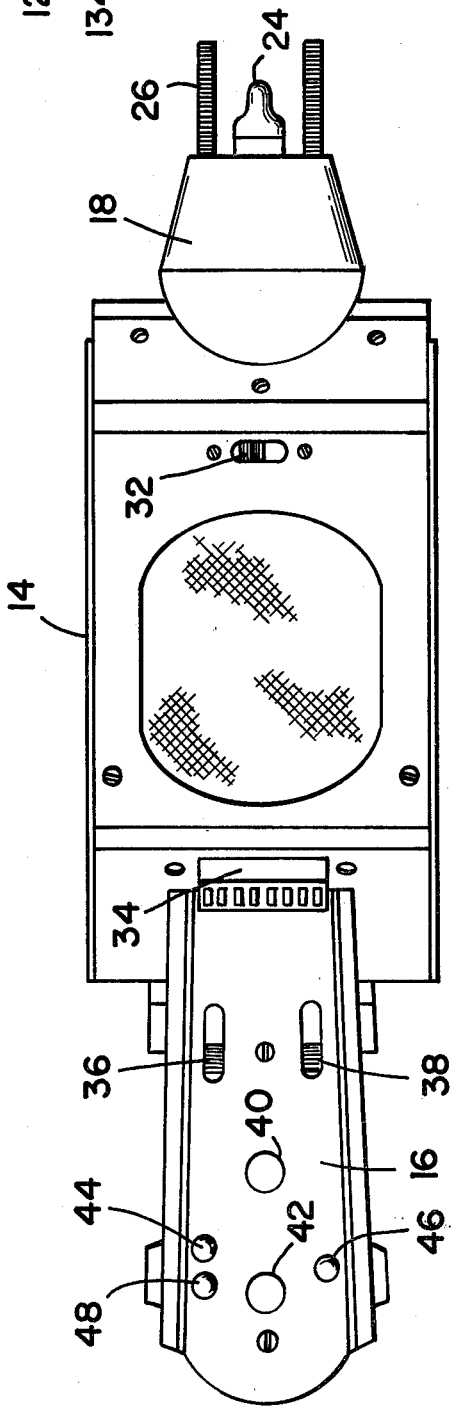
FIG. 5 is a top view of the toy gun of FIG. 2.

The toy gun 10 is activated by a trigger button 30 which is located in the handle portion 12 so that it can be easily depressed by a person's index finger. However, the controls of my toy gun device which can be preset to provide different combinations of sounds and light, are located on its body. Adjacent the speaker plate on the central body section 14 is a two position program switch 32 for varying the characteristic sound or decay time of a single shot or "stun" mode operation. Mounted on a sloping rear face of the central body section is a multi-pole micro-switch module 34 for providing different light frequency combinations and for altering the warbling frequency of the sound in its continuous or vibrato mode. Positioned on the rear body section 16, as shown in FIG. 5, is an on-off switch 36 for activating the power supply and a mode switch 38 that enables the operator to set the gun in either a "stun" (single shot) firing mode or in the continuous beam or vibrato mode. A first rotatable knob 40 provides a pitch control, and a second rotatable knob 42 which can be turned to further change the vibrato frequency of the sound. Adjacent these knobs are three indicator lights which are preferably light emitting diodes (LED's) 44, 46 and 48. The LED 44 turns on and the LED 46 commences to flash at the preset flash rate of the muzzle lamps 24 when the switch 36 is turned to the "on" position. When the trigger button 30 is pushed, the third LED 48 will flash in unison with the LED 46.

Figures 9, 9A:
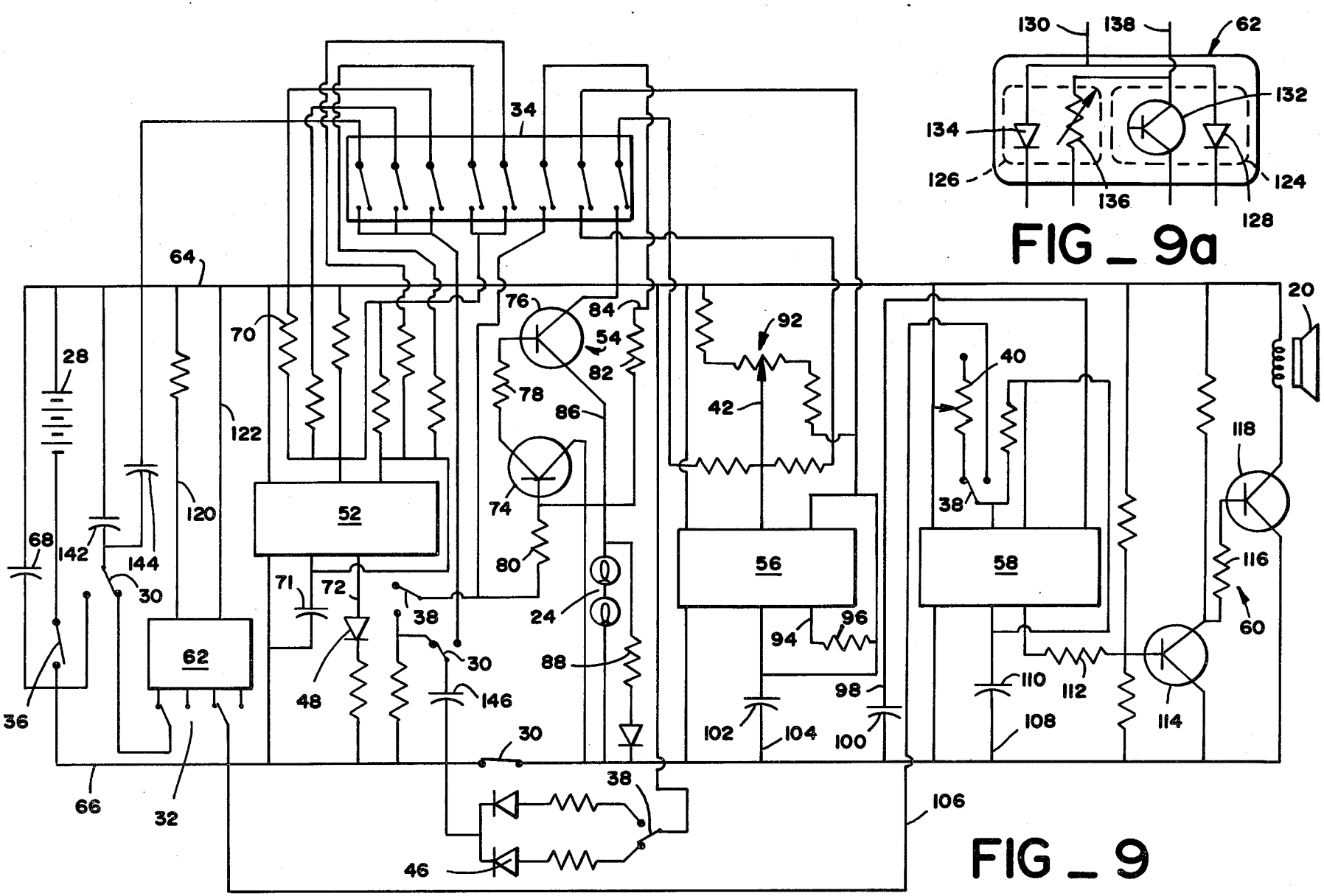
FIG. 9 is a detailed circuit diagram for the lamp and audio circuits for my toy gun; and FIG. *9a* is a diagram showing the tonal decay portion of the circuit.

Packaged conveniently within the handle is a small circuit board 50 supporting the various electrical components for producing the different audio modes and the flashing muzzle lamps 24, which will also be described in greater detail with respect to FIG. 9.

Figure 8:
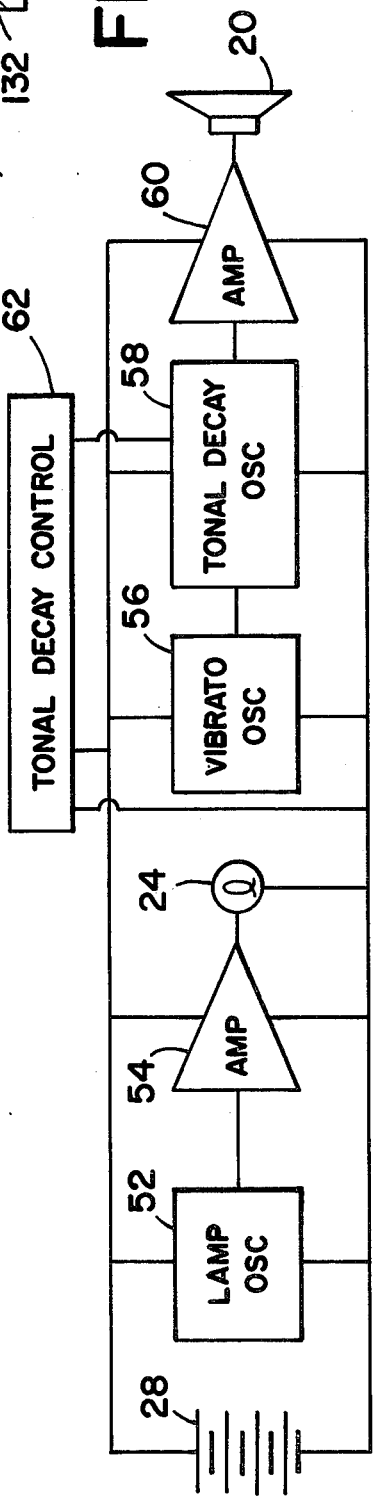
FIG. 8 is a block diagram showing the arrangement of major components of the lamp and audio circuits of a toy gun according to the invention.

The general arrangement and operation of the electronic circuit for my toy gun may be described with reference to the block diagram of FIG. 8. The power supply, as previously indicated, preferably is comprised of four AA size "pen-lite" dry cell batteries 28 and it is connected to all of the major components in parallel. In the lamp control section of the circuit, the power is first supplied to an oscillator 52 whose output is furnished to an amplifier 54 connected to the lamps 24. In the audio control section of the circuit the power is supplied to a second oscillator 56 and a third oscillator 58 in parallel, with the output of the latter one being furnished to an amplifier 60 connected to the speaker 20. Connected to the power source and third oscillator 46 is a tonal pitch control component 62.

The circuit and its components will now be described in greater detail with respect to FIG. 9 and 9*a*. The batteries 28 are connected to plus and minus leads 64 and 66 and connected to the negative side of the power supply is the on-off switch 36. In parallel with the batteries is a capacitor 68 which serves as a voltage regulator to prevent the three voltage controlled oscillators 52, 56 and 58 from distorting with each high current flash of the lamps. In the form described, the circuit has an idle current of about 35 milliamperes and a peak current of around 350 milliamperes when the trigger 30 is pulled. Due to this fairly high load, alkaline type batteries are preferred.

The first or lamp oscillator 52 is a slow speed square wave generator which is preferably provided in the form of an integrated circuit timer of a commercially available type (e.g. NE 555V). The timer rate is controlled by a series of resistors 70 connected from it to status switches two through five in the microswitch module 34. Actuation of these status switches in different combinations enable the resistors to be switched in and out of the circuit to vary the oscillator rate. One output lead from the timer device is connected through a capacitor 71 to the negative power lead. Another output lead 72 from this oscillator 52 is connected to the flash status LED 48 and also through a section of the mode switch 38 to the amplifier 54 which is a darlington type comprised of two transistors 74 and 76 and a resistor 78. In the lead from the mode switch to the amplifier 54 is a resistor 80. A resistor 82 is also connected in a lead 84 attached to one terminal of the micro-switch module 34 and the input to transistor 74. The lamps 24 are small penlight bulbs directly connected by a lead 86 to the power output of transistor 76 and to the negative power lead 66. In parallel with the lamps 24 is a resistor 88 and the LED 44. The resistors 80 and 82 control the time that the bulbs stay "on" in conjunction with a timing capacitor 90 connected to the trigger switch. The latter is also connected to the bipolar LED 46 and through a section of the mode switch 38 to the power lead 64 to provide an indication of the selected mode.

The second oscillator 56 in the audio section of the circuit also includes an integrated circuit timer (e.g. NE-555V). Connected between this timer circuit the positive power lead, and the micro switch module 34 is a series of resistors 92 including a potentiometer connected to the contract control knob 42 connected to provide preselected input values. When such values are applied, the oscillator will produce a square wave output in a lead 94 through a resistor 96 to a lead 98 that extends to the third oscillator 58. The lead 98 is connected through a capacitor 100 to the negative power line. Another capacitor 102 is connected from the oscillator 56 timer through a lead 104 to the negative power line 66.

The third oscillator 58 of the audio section includes another integrated circuit timer (e.g. NE-555V) whose input is connected through a section of the mode switch 38 and a variable potentiometer (controllable by the pitch control knob 40) to the positive power lead 64. When the aforesaid section of the mode switch is in the position shown in FIG. 7, the circuit is in the continuous vibrato sound mode. As shown, the other pole of this mode switch section is connected by a lead 106 to the tonal decay control 62. One output terminal of the timer 58 is connected to a lead 108 through a capacitor 110 to the negative power lead 66. Another output of this third oscillator is connected through a resistor 112 to the base of a PNP transistor 114 which is connected through a resistor 116 to another transistor 118 whose output is connected to the speaker 20. These latter two transistors comprise the amplifier 60 which is also another darlington type amplifier.

Figure 6:
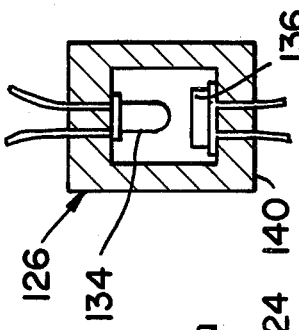
FIG. 6 is an enlarged view in section showing one form of optoelectronic component used in the tonal decay control component of my device.
Figure 7:
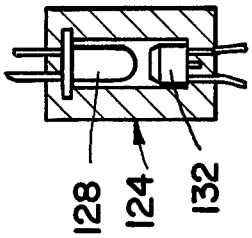
FIG. 7 is an enlarged view in section showing another form of optoelectronic component used in the total decay control component.

As shown in the detailed circuit diagram of FIG. 9*a*, the tonal decay component 62 is connected by two input leads 120 and 122 from the positive power lead and internally it comprises two optoelectric devices 124 and 126. The first device 124 comprises a LED 128 that produces red light upon activation and is connected to an input lead 130. Adjacent to it is a photo-transistor 132 having a lens of a type that is commercially available and capable of putting out an output proportional to light striking it. The second optoelectric device 126 also comprises a LED 134 similar to that of the first device and connected to the same power lead 130. Adjacent this latter LED is a cadmuim sulfide photocell 136. The photo-transistor and the photocell are both connected to a common input lead 138 connected to the power lead 64. Somewhat schematic structural views in cross-section of these two optoelectric components 124 and 126 are shown in FIGS. 6 and 7 respectively. Both devices are preferably mounted in a housing 140 made of an opaque dielectric or plastic material. In cell or device 124, the clear red and prefocused LED 128 is mounted less than one millimeter from the lens of the phototransistor 132. The base lead of this transistor is not connected, but the collector is connected to the positive lead. In the cell or device 126 the prefocused LED 134 is mounted less than one millimeter from the serving surface of the cadmium sulfide photocell 136. The interior cell wall is preferably coated with a reflective material which increase efficiency by roughly ten percent.

In operation, a user of the toy gun 10 first selects the desired mode of operation by positioning the mode switch 38 in the appropriate position. If he selects the single shot or "stun" mode, he may also preset the program switch 38 to the desired position. Assuming that a single blast or "stun" made was desired, the mode switch and the program switch would be placed in the positions shown schematically in FIG. 9. The microswitch module 34 would be set with a particular combination of switch contacts closed to provide the desired inputs to the oscillators and hence the desired frequency outputs. Now, with the on-off switch 36 moved to the "on" position, the gun can be activated when the trigger button 30 is pressed. With the circuit "on", before the trigger is pressed or pulled, the trigger switch 30 is closed, so that three capacitors 142 and 144 and 146 connected to it are charged from the power source or batteries.

Now, when the trigger is pulled, the trigger switch is moved to its other contacts and the capacitors 142, 144 and 146 are discharged. When 142 and 144 discharge, a flow of current is supplied to the optoelectric device 126 of the tonal decay control 62. This causes the LED 134 to light up. The resistance of the cadmium sulfide photocell 136 starts out at a low level of around 1000 ohms in response to the light from LED 135 and as this LED gradually dims out, the resistance of the cadmium sulfide photocell rises concurrently to a final volume of around 2 million ohms. Since the cadmium cell 136 is connected to the bias of the third oscillator 58 through lead 106 and the mode switch 38, the increased resistance causes the tone pitch to drop precipitously from a relatively high pitch to a much lower pitch. After the capacitors 142 and 144 have released their entire charge over a small time interval (e.g. one second) no current is flowing in the circuit and hence there is silence causing the trigger switch to return to its original "off" contact position until it is again pulled to repeat the cycle. During each trigger cycle, the capacitor 146 will also release its entire charge through resistor 80 which momentarily activates the amplifier 54 causing the lamps 24 to flash simultaneously with the produced sound.

The single shot or "stun" mode can be varied by moving the program switch 32 on the tonal control 62 to its alternate position. This activates the alternate optoelectronic device 124 which will produce the same general effects as previously described with respect to the device 126 but with a much shorter decay time interval. This results in a short burst of a more concentrated sound having a different characteristic. Thus, in the "stun" or single short mode, with the program switch in position to activate the phototransistor 132, each trigger activation produces a rapid and thus a short but concentrated sound (e.g. one second or less). However, with the program switch in the alternate position to activate the cadmium sulfide cell, each trigger activation produces an initial sound of higher pitch with a much slower decay time of 3–4 seconds.

In the continuous vibrato mode of operation, the function of the circuit is somewhat different. Here, the mode switch 38 is moved to the continuous position which moves the three switch poles to the contacts opposite from those shown in FIG. 9. The program switch 32 can be in either position since it is essentially inoperative in this mode. However, the capacitors 142 and 144, will discharge again upon trigger activation and will tend to stabilize the operation of the first oscillator. Essentially, these capacitors function as filters in parallel with the main filtering capacitor 68 to further regulate the voltage from the battery.

Now, when the trigger is pulled, its switch contacts close, which connects the battery to the entire circuit. With the mode switch 38 in the continuous position, the pulsating square wave signal from the first oscillator timer 52 is fed into the amplifier 54 through resistor 80 causing the lamps 24 to flash on with each positive half cycle of the alternating square wave signal. Simultaneously, the second and third oscillators 56 and 58 produce a continuous, modulated tone whose frequency can be controlled by the pitch control potentiometer 40. The output of the oscillator 56 through resistor 96 produces a square wave signal which is filtered by capacitor 100 into a rounded sine wave signal and is sent to one of the third oscillator timer 58. This causes its otherwise continuous tone to be modulated through two octaves of pitch at the same frequency as the signal from the second oscillator and produces the warbling or vibrato sound through the speaker.

When the pitch control potentiometer 40 is adjusted, its resistance varied to cause the bias to the amplifier 60 to be changed, thereby changing the sound pitch of the overall vibrato.

When the contrast control potentiometer 42 is adjusted, the high or low pitch dominance is charged to vary the overall sound characteristic of the vibrato. This is caused by increasing or decreasing the amount of the plus or positive half cycles supplied to the third oscillator.

From the foregoing it is apparent that the present invention provides a toy gun having audio and light outputs that closely simulate familiar "space-age" sounds from prior movie and T.V. productions as well as new combinations thereof. Moreover, the controls provided enable the user to vary the mode and characteristics of the light and sounds produced to get the circuitry for achieving the versatility of sound and light production is compact so as to be easily packaged and enclosed within the gun housing.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A toy gun device for producing controllable audio and visual effect simulating a fictitious "ray" type weapon, said device comprising:

a body in the general shape of a hand gun having a handle attached to a central section with a barrel-like front end portion;

power means in said body;

lamp means at said front end portion;

audio speaker means in said central section;

circuit means connected to said power means including audio generation means connected to said speaker means and said power means and including control means for producing a continuously warbling vibrato sound at a preselected level and frequency, and lamp control means for actuating said lamp means to flash on and off during the warbling sound produced by said audio generation means;

and trigger means on said handle for simultaneously activating said lamp control means and said audio generation means to simulate the firing of said gun-like toy device.

2. The toy gun device as described in claim 1 wherein said circuit means includes a tonal control means for providing a decaying input to said audio generation means that produces a single "shot" or audio burst when said trigger means is pulled once; and a mode switch for enabling a user of said device to preselect the continuous or the "one-shot" mode of operation.

3. The toy gun device as described in claim 2 wherein said tonal control means comprises a pair of optoelectric devices, a first one of which provides a decay time and thus a single shot audio response time of around one second, and a second one of which provides a decay time of around two to four seconds; and program switch means for preselecting either said first or said second optoelectric device.

4. The toy gun device as described in claim 3 wherein said first optoelectric device comprises a light emitting diode mounted within an enclosure adjacent to a phototransistor to provide a relatively short decay time.

5. The toy gun device as described in claim 3 wherein said second optoelectric device comprises a light emitting diode mounted within an enclosure adjacent to a cadmium sulfide photocell.

6. The toy gun device as described in claim 1 wherein said circuit means comprises a first oscillator including an integrated timer circuit for producing a square wave output at continuous frequency and connected to a first amplifier whose output is connected to said lamp means, a second oscillator connected to a third oscillator, a second amplifier connected to said third oscillator whose output is connected to said audio speaker means.

7. The toy gun device as described in claim 6 including a first variable resistor means connected to an input to said third oscillator for altering the audio pitch of the sound produced.

8. The toy gun device as described in claim 7 including a second variable resistor means connected to an input to said second oscillator for altering the audio contract of the sound produced.

9. The toy gun device as described in claim 8 wherein said first and second variable resistors are connected to knobs extending from a rear section of said body extending rearwardly from said central section.

10. The toy gun device as described in claim 1 wherein said speaker means in said central body section is directed upwardly with its grill in a horizontal plane and said power means in the form of batteries are retained within said central body section on opposite sides of said speaker means.

11. The toy gun device as described in claim 1 wherein said lamp means comprise two penlight incandescent bulbs mounted in spaced apart sockets at the muzzle end of said device and controlled to light alternatively by said circuit means.

* * * * *